US005823171A

United States Patent [19]

Farmer et al.

[11] Patent Number: 5,823,171

[45] Date of Patent: Oct. 20, 1998

[54] ENGINE CONTROL SYSTEM FOR AN ENGINE COUPLED TO A FUEL VAPOR RECOVERY

[75] Inventors: David George Farmer, Plymouth; Gopichandra Surnilla; Daniel V. Orzel, both of Westland, all of Mich.

[73] Assignee: Ford Global Technologies, Inc., Dearborn, Mich.

[21] Appl. No.: 826,607

[22] Filed: Apr. 3, 1997

[51] Int. Cl.[6] ..... F02D 41/00

[52] U.S. Cl. ..... 123/704

[58] Field of Search ..... 123/704, 494, 123/527

[56] References Cited

U.S. PATENT DOCUMENTS 4,924,837 5/1990 Chujo et al ..... 123/494

5,048,493 9/1991 Orzel et al. ..... 123/489

5,201,303 4/1993 Kojima ..... 123/704

5,333,591 8/1994 Korsmeier et al. ..... 123/527

5,363,832 11/1994 Suzumura et al. ..... 123/704

*Primary Examiner*—Raymond A. Nelli

*Attorney, Agent, or Firm*—Allan J. Lippa

[57] ABSTRACT

Air is purged through a fuel vapor recovery system to induct a mixture of purged air and fuel vapor from the fuel vapor recovery system into an engine air/fuel intake. An air/fuel vapor ratio of the inducted mixture is provided from a hydrocarbon sensor positioned in the engine air/fuel intake. Fuel vapor flow is then calculated and this calculation used to adjust fuel delivered to the engine to maintain a desired lean air/fuel ratio.

10 Claims, 4 Drawing Sheets

ENGINE CONTROL SYSTEM FOR AN ENGINE COUPLED TO A FUEL VAPOR RECOVERY

BACKGROUND OF THE INVENTION

The field of the invention relates to air/fuel control for engines having a fuel vapor recovery system coupled between the fuel supply and the engine's air/fuel intake.

Engine air/fuel control systems are known which operate at air/fuel ratios lean of stoichiometric air/fuel ratios. An open loop fuel quantity is typically generated by dividing a measurement of inducted mass airflow by a desired lean air/fuel ratio. Such systems may also include a fuel vapor recovery system wherein fuel vapors are purged from the fuel system into the engine's air/fuel intake.

The inventors herein have discovered numerous problems with the above approaches. For example, when fuel vapors are purged into the engine air/fuel intake during lean burn operating modes, the engine will not run as lean as it is capable of running and fuel economy will therefore not be maximized.

SUMMARY OF THE INVENTION

An object of the invention herein is to purge fuel vapors from an engine fuel system into the engine air/fuel intake while maintaining engine operation at a desired lean air/fuel ratio during lean burn operating modes.

The above object is achieved and problems with prior approaches overcome by providing an apparatus and a control method for controlling air/fuel operation of an engine coupled to a fuel system. In one particular aspect of the invention, the method comprises the steps of: measuring ambient air inducted into the air/fuel intake; delivering fuel to the engine in proportion to the inducted ambient air measurement; purging air through the fuel vapor recovery system to induct a mixture of the purged air and fuel vapor from the fuel vapor recovery system into the air/fuel intake; measuring an air/fuel vapor ratio of the inducted mixture of purged air and ambient air and fuel vapor from a hydrocarbon sensor positioned in the air/fuel intake; calculating mass per unit of time of the fuel vapor inducted into the air/fuel intake from the air/fuel vapor measurement and the inducted ambient air measurement; and adjusting the delivered fuel with the calculated fuel vapor mass to maintain a desired air/fuel ratio.

An advantage of the above aspect of the invention is that lean air/fuel operation can be provided at a desired lean value while accommodating the purging of fuel vapors from the fuel system.

BRIEF DESCRIPTION OF THE DRAWINGS

The above object is achieved, problems of prior approaches overcome, and advantages obtained, by the embodiment in which the invention is used to advantage as now described with reference to the attached drawings wherein.

DESCRIPTION OF AN EMBODIMENT

Figure 1:
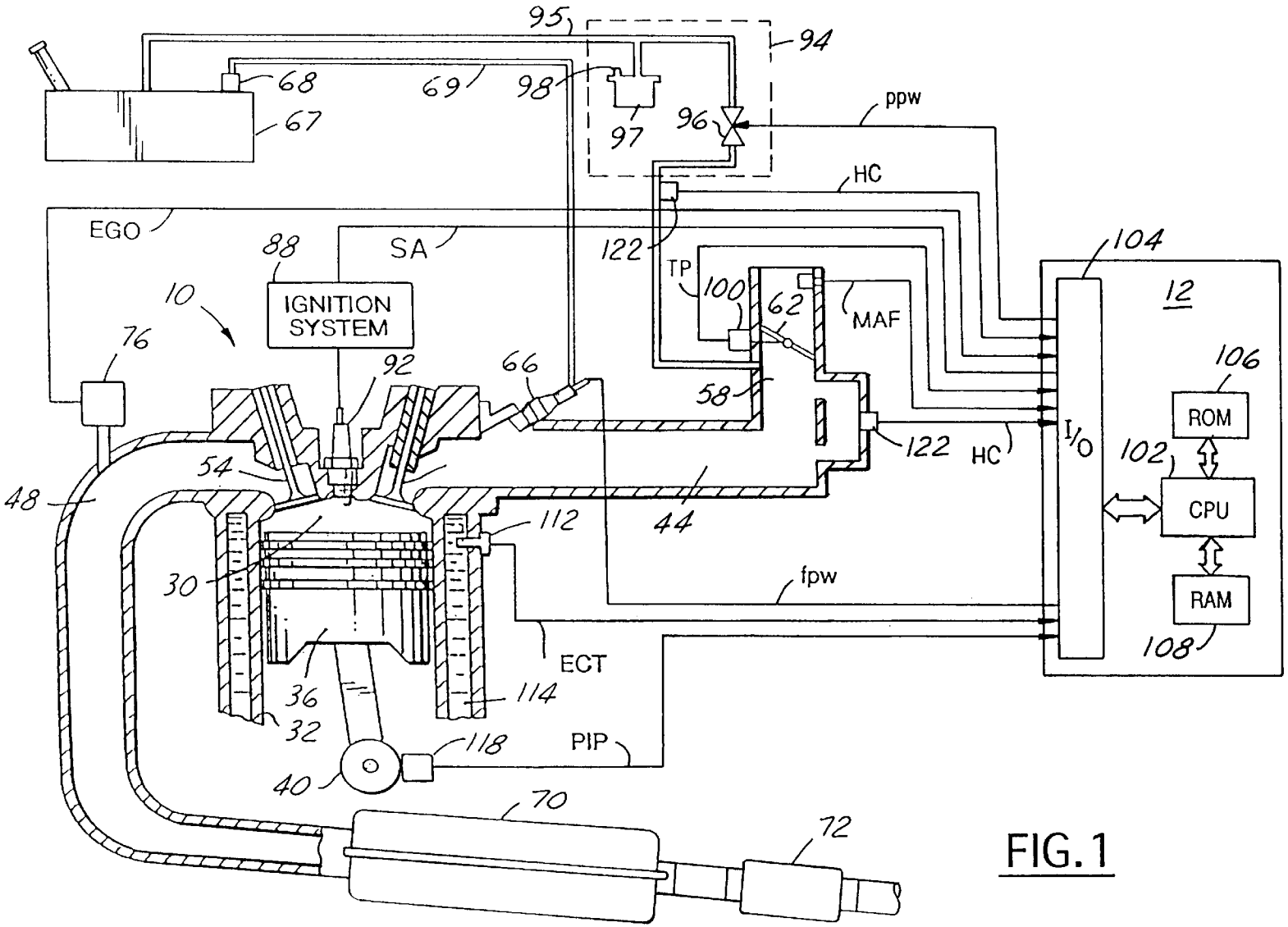
FIG. 1 is a block diagram of an embodiment in which the invention is used to advantage.

Internal combustion engine 10 comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Intake manifold 44 is also shown having fuel injector 66 coupled thereto for delivering liquid fuel in proportion to the pulse width of signal fpw from controller 12. Fuel is delivered to fuel injector 66 by a conventional fuel system including fuel tank 67, fuel pump 68, and fuel rail 69.

Catalytic converter 70 is shown coupled to exhaust manifold 48 upstream of nitrogen oxide trap 72. Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is selected at stoichiometry (14.3 lb. of air per pound of fuel, for example) which falls within the peak efficiency window of catalytic converter 70. During lean burn air/fuel operating modes, the desired air/fuel ratio is selected at a desired lean value considerably leaner than stoichiometry (18–22 lb. of air per pound of fuel, for example) to achieve improved fuel economy.

Fuel vapor recovery system 94 is shown coupled between fuel tank 67 and intake manifold 44 via purge line 95 and purge control valve 96. In this particular example, fuel vapor recovery system 94 includes vapor canister 97 which is connected in parallel to fuel tank 67 for absorbing fuel vapors therefrom by activated charcoal contained within the canister. Further, in this particular example, valve 96 is a pulse width actuated solenoid valve responsive to pulse width signal ppw from controller 12. A valve having a variable orifice may also be used to advantage such as a control valve supplied by SIEMENS as part no. F3DE-9C915-AA.

During fuel vapor purge, air is drawn through canister 97 via inlet vent 98 absorbing hydrocarbons from the activated charcoal. The mixture of purged air and vapors is then inducted into intake manifold 44 via purge control valve 96. Concurrently, fuel vapors from fuel tank 67 are drawn into intake manifold 44 via purge control valve 96.

Controller 12 is shown in FIG. 1 as a conventional microcomputer including: microprocessor unit 102, input/output ports 104, an electronic storage medium for executable programs and calibration values shown as read only memory chip 106 in this particular example, random access memory 108, and a conventional data bus. Controller 12 is shown receiving various signals from sensors coupled to engine 10, in addition to those signals previously discussed, including: measurement of inducted mass air flow (MAF) from mass air flow sensor 110 which is coupled to throttle body 58; engine coolant temperature (ECT) from temperature sensor 112 coupled to cooling sleeve 114; a profile ignition pickup signal (PIP) from Hall effect sensor 118 coupled to crankshaft 40; throttle position signal TP from throttle position sensor 120; and signal HC from hydrocarbon sensor 122 coupled to throttle body 58 downstream of the coupling of fuel vapor recovery system 94 to throttle body 58.

Figure 2:
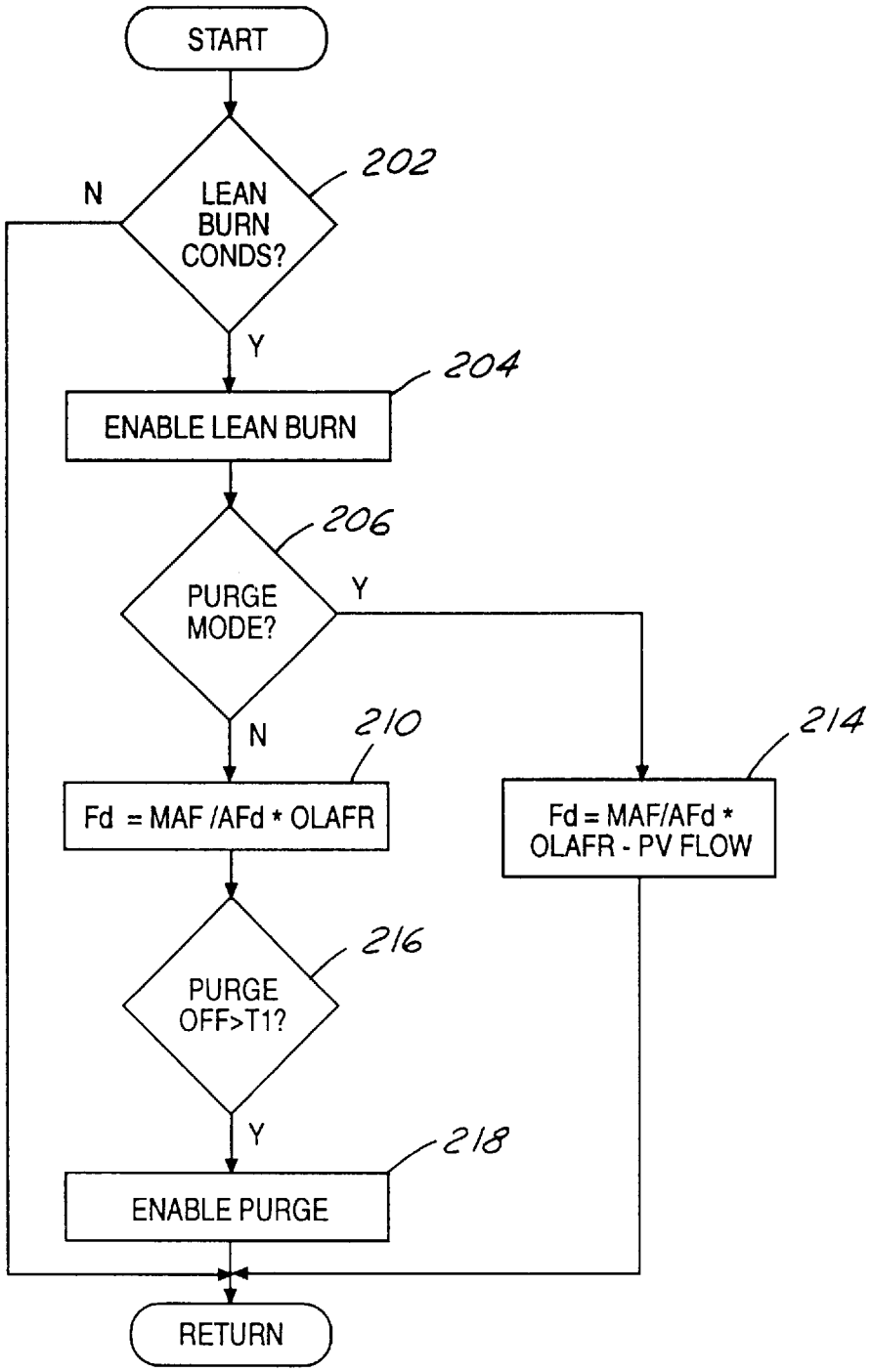
FIGS. 2–4 are high level flowcharts illustrating various steps performed by a portion of the embodiment shown in FIG. 1.

Referring now to FIG. 2, lean air/fuel ratio operation or lean burn operation is now described. When lean burn operating conditions exist, such as when engine 10 is not accelerating, the lean burn mode is enabled (steps 202 and 204). When fuel vapor recovery system 94 is not being purged (step 206), fuel delivery signal Fd is generated by dividing the product of desired air/fuel ratio AFd, and the normalized open loop air/fuel ratio signal OLAFR, into mass airflow signal MAF. In this particular example desired air/fuel ratio AFd is in a range of 18 to 24 lbs.air/lbs.fuel. And, the normalized open loop air/fuel ratio signal OLAFR is unity (step 210).

On the other hand, when in both the lean burn mode (step 204) and the purge mode (step 206), fuel delivery signal Fd is generated by subtracting a calculation of purge vapor flow (PVFLOW) from the previous equation described with reference to step 210. This calculation is shown in step 214 of FIG. 2. As described in greater detail later herein with particular reference to FIG. 3, purge vapor flow PVFLOW is a calculation of mass of fuel vapors per minute inducted into throttle body 58.

Continuing with FIG. 2, when purging of fuel vapor recovery system 94 has been off for more than time T1 (steps 206, 210, and 216), purge is enabled during step 218.

Figure 3:
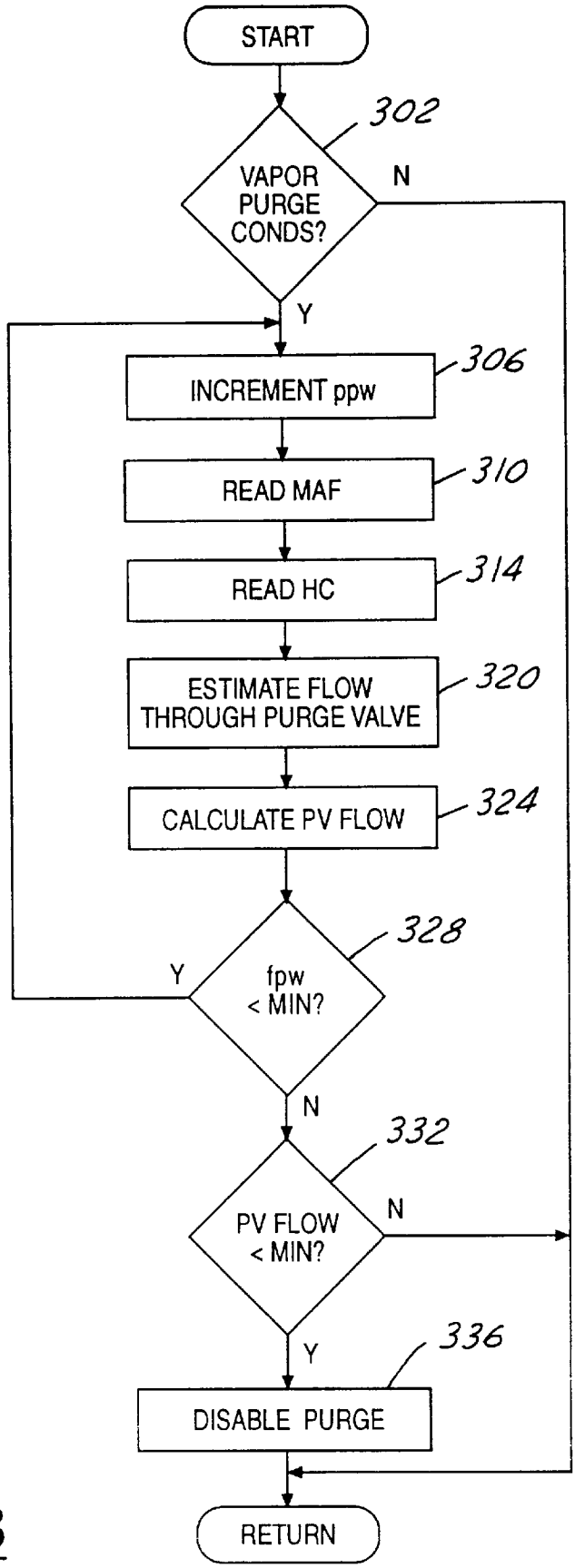

The subroutine described with particular reference to FIG. 3 is entered when vapor purge conditions are satisfied (step 302). Such conditions include engine coolant temperature ECT being above a threshold temperature. When vapor purge conditions are met, the duty cycle of pulse width signal ppw, which actuates purge valve 96, is incremented a preselected amount (step 306). The flow of purged air and fuel vapor through fuel vapor recovery system 94 into throttle body 58 is thereby increased a preselected amount in direct proportion to the increase in duty cycle of pulse width signal ppw. As described in greater detail below, the increment in pulse width signal ppw is gradually incremented until a maximum purge flow is achieved.

After pulse width signal ppw is incremented, mass airflow signal MAF (step 310), and hydrocarbon signal HC (step 314) are read. Hydrocarbon signal HC provides a normalized output proportional to the air/fuel vapor ratio inducted through throttle body 58. During step 320, the flow rate of purged air and fuel vapors through purge valve 96 is estimated as a function of fuel pulse width signal ppw. The mass flow of purged fuel vapors in pounds per minute is calculated in step 324 by the following equation:

PVFLOW=MAF+ESTIMATED PURGE FLOW*PURGE FLOW MULTIPLIER/NORMHC*14.65

Where: the PURGE FLOW MULTIPLIER is a function of engine load which accounts for loss of flow at low vacuum pressure of intake manifold 44. NORMHC is the normalized air/fuel vapor ratio provided by HC sensor 122. 14.65 is the stoichiometric value of combustion gases in lbs. air/lbs. fuel.

Continuing with FIG. 3, when fuel pulse width signal fpw, which actuates fuel injector 66, is less than a minimum value associated with linear fuel injector characteristics (step 328), pulse width signal ppw is incremented another predetermined amount in step 306 and the above described subroutine repeated. On the other hand, when fuel pulse width signal fpw is greater than the minimum value (step 328), the subroutine proceeds to step 332 where purge vapor flow PVFLOW is checked against its minimum value. If purge vapor flow PVFLOW has not reached its minimum value, the subroutine described above is repeated. And, when purge vapor flow PVFLOW is less than its minimum value (step 332), fuel vapor purge is disabled (step 336).

Figure 4:
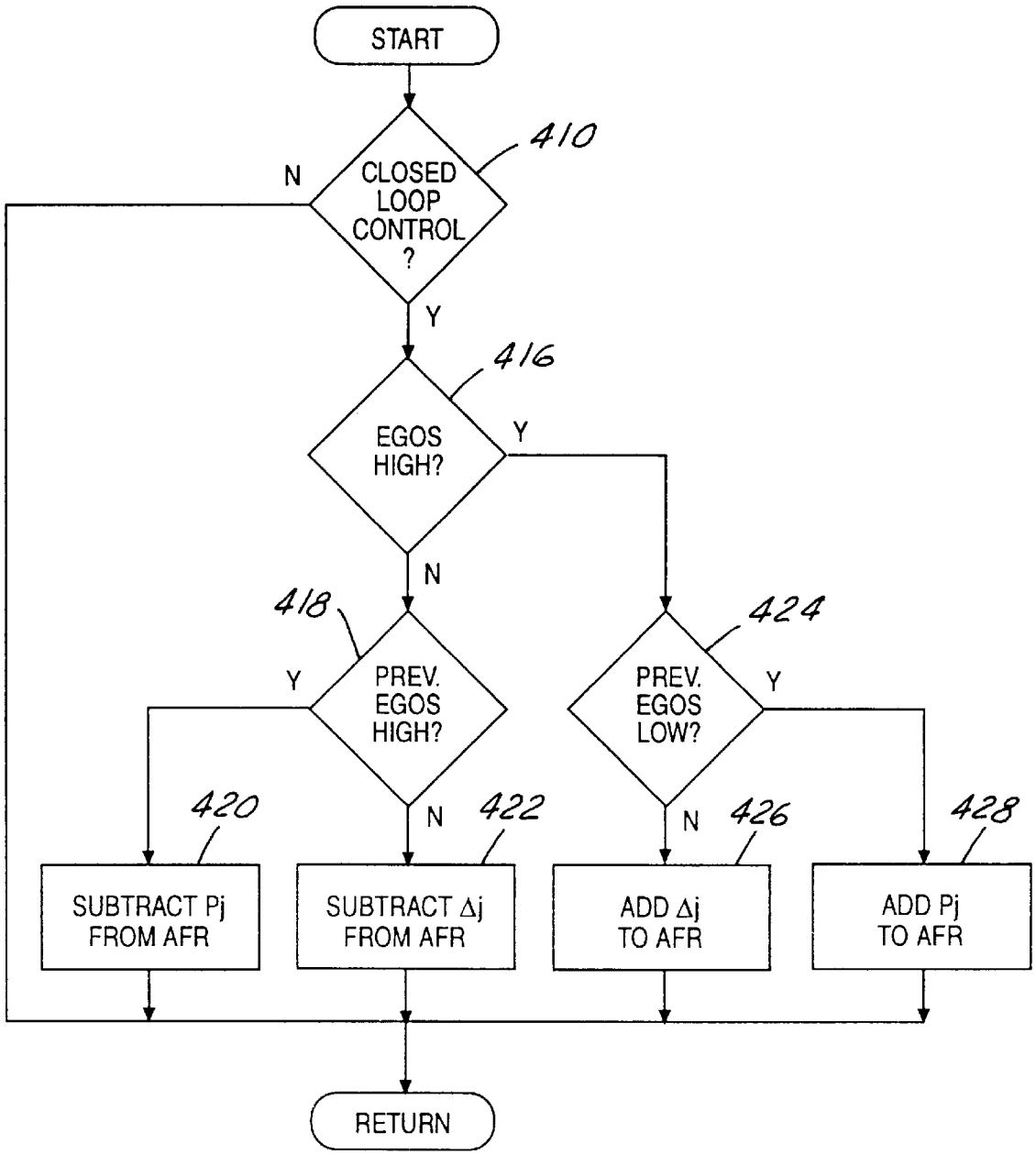

The air/fuel feedback routine executed by controller 12 to generate normalized air/fuel ratio AFR is now described with reference to the flowchart shown in FIG. 4. Signal AFR is used as an air/fuel control feedback signal when engine 10 is operating in a feedback control mode to maintain average air/fuel ratio at stoichiometry. In the feedback control mode, fuel delivery signal Fd–MAF/AFd*AFR where desired air/fuel ratio AFd is a stoichiometric value. This subroutine will proceed only when feedback control or closed-loop control conditions are present (step 410) and controller 12 is not in the fuel vapor learning mode (step 412). When the above conditions are satisfied, two-state signal EGOS is generated from signal EGO in the manner previously described herein with reference to FIG. 1. Preselected proportional term Pj is subtracted from normalized air/fuel ratio AFR (step 420) when signal EGOS is low (step 416), but was high during the previous background loop of controller 12 (step 418). When signal EGOS is low (step 416), and was also low during the previous background loop (step 418), preselected integral term Δj is subtracted from signal AFR (step 422).

Similarly, when signal EGOS is high (step 416), and was also high during the previous background loop of controller 12 (step 424), integral term Δi is added to signal AFR (step 426). When signal EGOS is high (step 416), but was low during the previous background loop (step 424), proportional term Pi is added to signal AFR (step 428).

In accordance with the above described operation, signal AFR is generated from a proportional plus integral controller (P1) responsive to exhaust gas oxygen sensor 76. The integration steps for integrating signal EGOS in a direction to cause a lean air/fuel correction are provided by integration steps Δi, and the proportional term for such correction provided by Pj. Similarly integral term Δj and proportional term Pj cause rich air/fuel correction.

This concludes the description of an example of operation in which the invention is used to advantage. The reading of it by those skilled in the art will bring to mind many modifications and alterations without departing from the spirit and scope of the invention. Accordingly, it is intended that the invention be limited only by the following claims.

What is claimed:

1. A method for controlling air/fuel ratio of an engine having a fuel vapor recovery system coupled to an air/fuel intake, comprising the steps of:

measuring ambient air inducted into the air/fuel intake;

delivering fuel to the engine in proportion to said inducted ambient air measurement;

purging air through the fuel vapor recovery system to induct a mixture of said purged air and fuel vapor from the fuel vapor recovery system into the air/fuel intake;

measuring an air/fuel vapor ratio of said inducted mixture of purged air and ambient air and fuel vapor from a hydrocarbon sensor positioned in the air/fuel intake;

calculating mass per unit of time of said fuel vapor inducted into the air/fuel intake from said air/fuel vapor measurement and said inducted ambient air measurement; and adjusting said delivered fuel with said calculated fuel vapor mass to maintain a desired air/fuel ratio.

2. The method recited in claim 1 wherein said step of delivering fuel comprises dividing said measurement of inducted ambient air by said desired air/fuel ratio.

3. The method recited in claim 1 wherein said desired air/fuel ratio is lean of stoichiometry.

4. A method for controlling air/fuel ratio of an engine having a fuel vapor recovery system coupled to an air/fuel intake via a purge control valve, comprising the steps of:

measuring ambient air inducted into the air/fuel intake;

generating a fuel delivery signal for delivering fuel to the engine by dividing said inducted ambient air measurement by a desired air/fuel ratio;

purging air through the fuel vapor recovery system to induct a mixture of said purged air and fuel vapor from the fuel vapor recovery system into the air/fuel intake;

providing a normalized air/fuel vapor ratio signal from a hydrocarbon sensor positioned in the air/fuel intake which is proportional to a ratio of said inducted mixture of purged air and ambient air to said inducted fuel vapor;

generating an air/fuel vapor ratio by multiplying said normalized air/fuel vapor ratio signal by a stoichiometric air/fuel ratio;

calculating mass per unit of time of said fuel vapor inducted into the air/fuel intake from said air/fuel vapor ratio and said inducted ambient air measurement by dividing said air/fuel vapor ratio into an estimate of total flow of said inducted mixture of purged air and ambient air and fuel vapor; and adjusting said delivered fuel with said calculated fuel vapor mass to maintain a desired air/fuel ratio.

5. The method recited in claim 4 further comprising a step of generating an actuating signal for actuating said purge control valve.

6. The method recited in claim 5 wherein said estimate of total flow of said inducted mixture of purged air and ambient air and fuel vapor is generated in relation to on time of said actuating signal.

7. The method recited in claim 4 wherein said desired air/fuel ratio is lean of stoichiometry.

8. A method for controlling air/fuel ratio of an engine having a fuel vapor recovery system coupled to an air/fuel intake, comprising the steps of:

measuring ambient air inducted into the air/fuel intake;

delivering fuel to the engine in proportion to said inducted ambient air measurement;

purging air through the fuel vapor recovery system to induct a mixture of said purged air and fuel vapor from the fuel vapor recovery system into the air/fuel intake;

measuring an air/fuel vapor ratio of said inducted mixture of purged air and ambient air and fuel vapor from a hydrocarbon sensor positioned in the air/fuel intake;

calculating mass per unit of time of said fuel vapor inducted into the air/fuel intake from said air/fuel vapor measurement and said inducted ambient air measurement; and adjusting said delivered fuel with said calculated fuel vapor mass to maintain a desired air/fuel ratio.

9. An article of manufacture comprising:

a computer storage medium having a computer program encoded therein for causing a computer to control air/fuel operation of an engine having a fuel vapor recovery system coupled to an air/fuel intake, said computer storage medium comprising:

measuring code means for causing a computer to measure ambient air inducted into the air/fuel intake;

fuel delivery code means for causing a computer to deliver fuel to the engine in proportion to said inducted ambient air measurement;

purge code means for causing a computer to purge air through the fuel vapor recovery system to induct a mixture of said purged air and fuel vapor from the fuel vapor recovery system into the air/fuel intake;

measuring code means for causing a computer to measure an air/fuel vapor ratio of said inducted mixture of purged air and ambient air and fuel vapor from a hydrocarbon sensor positioned in the air/fuel intake;

calculating code means for causing a computer to calculate mass per unit of time of said fuel vapor inducted into the air/fuel intake from said air/fuel vapor measurement and said inducted ambient air measurement; and adjusting code means for causing a computer to adjust said delivered fuel with said calculated fuel vapor mass to maintain a desired air/fuel ratio.

10. The article recited in claim 9 wherein said computer storage medium comprises a memory chip.

* * * * *